US010551024B2

(12) United States Patent
Chen et al.

(10) Patent No.: US 10,551,024 B2
(45) Date of Patent: Feb. 4, 2020

(54) COMBINATION REAR LAMP

(71) Applicants: Hsin-Hsi Chen, Tainan (TW); Shin-An Chen, Tainan (TW)

(72) Inventors: Hsin-Hsi Chen, Tainan (TW); Shin-An Chen, Tainan (TW)

( * ) Notice: Subject to any disclaimer, the term of this patent is extended or adjusted under 35 U.S.C. 154(b) by 0 days.

(21) Appl. No.: 16/010,630

(22) Filed: Jun. 18, 2018

(65) Prior Publication Data

US 2019/0383461 A1 Dec. 19, 2019

(51) Int. Cl.

| | |
|---|---|
| ***F21S 43/00*** | (2018.01) |
| ***F21S 43/241*** | (2018.01) |
| ***F21S 43/14*** | (2018.01) |
| *F21Y 113/10* | (2016.01) |
| *F21Y 115/10* | (2016.01) |

(52) U.S. Cl.

CPC ..... *F21S 43/241* (2018.01); *F21S 43/14* (2018.01); *F21Y 2113/10* (2016.08); *F21Y 2115/10* (2016.08)

(58) Field of Classification Search

CPC ... F21S 43/235–245; F21S 43/249–251; F21S 43/14; F21Y 2113/10; F21Y 2115/10

See application file for complete search history.

(56) References Cited

U.S. PATENT DOCUMENTS

| | | | | |
|---|---|---|---|---|
| 9,010,975 | B2 | 4/2015 | Norris et al. | |
| 9,656,598 | B1 * | 5/2017 | Salter | B60Q 1/0011 |
| 2004/0208016 | A1 * | 10/2004 | Kazaoka | F21S 43/247 362/511 |
| 2008/0019139 | A1 * | 1/2008 | Dubosc | F21S 43/249 362/511 |
| 2014/0293630 | A1 * | 10/2014 | Domini | G02B 6/001 362/487 |
| 2014/0376245 | A1 * | 12/2014 | Ritter | B60Q 1/0041 362/511 |
| 2015/0078025 | A1 * | 3/2015 | Kleiner | F21S 41/24 362/511 |
| 2018/0094790 | A1 * | 4/2018 | Greene | H05B 33/0851 |
| 2018/0195682 | A1 * | 7/2018 | Fisher | B60Q 1/34 |

* cited by examiner

*Primary Examiner* — Gerald J Sufleta, II

(74) *Attorney, Agent, or Firm* — Rosenberg, Klein & Lee

(57) ABSTRACT

A combination rear lamp is revealed. A light emitting unit is disposed in a mounting space formed between a lamp base and a lamp cover. A plurality of light emitting diodes (LEDs) is arranged at a substrate of the light emitting unit. A transparent first area is formed on a middle part of the lamp cover and a translucent second area is formed around the first area. A light guide bar is located directly under the first area and its length is longer than that of the first area. Two LEDs that emit white light are corresponding to light incident parts on two sides of the light guide bar respectively. Thereby white light emitted and transmitted through the light guide bar and the first area of the lamp cover is projected in a three-dimensional sense. The LEDs and light spot emitted will not be seen through the lamp cover.

9 Claims, 7 Drawing Sheets

COMBINATION REAR LAMP

BACKGROUND OF THE INVENTION

Field of the Invention

The present invention relates to a combination rear lamp, especially to a combination rear lamp that projects three-dimensional and uniform light with more lighting patterns and having an enhanced aesthetic appearance.

Description of Related Art

Refer to U.S. Pat. No. 9,010,975B2, a multi-colored vehicle rear lamp is revealed. The rear lamp includes a light transmissive cover having a red first illuminated surface area and a clear second illuminated surface area. It has a first LED light emitter emitting red light and located directly beneath the red first area, a second LED light emitter emitting white light and located directly beneath the clear second area and a third LED light emitter that emits red light also located directly beneath the clear second area.

Users can see light spots emitted from the second light emitter and the third light emitter located beneath the second area because that the second area is clear. This affects the beauty of the rear lamp. Moreover, light emitted from the second and the third light emitters is projected through the clear second area and diffused in all directions. Thus the light projected causes discomfort and glare to road users behind the car. The road users behind the car can only rely on on/off state and luminous intensity of the LED for identification of the movement of the vehicle. Thus they are easy to make a wrong judgment and have traffic accidents due to poor visibility caused by bad weather.

SUMMARY OF THE INVENTION

Therefore it is a primary object of the present invention to provide a combination rear lamp in which light projected therefrom is three-dimensional and uniform. The light projected has more lighting patterns and the rear lamp has a beautiful appearance.

In order to achieve the above object, a combination rear lamp according to the present invention mainly includes a light emitting unit is disposed in a mounting space formed between a lamp base and a lamp cover. A plurality of light emitting diodes (LEDs) is arranged at a substrate of the light emitting unit. A transparent first area is formed on a middle part of the lamp cover and a translucent second area is formed around the first area. A light guide bar is located directly under the first area of the lamp cover and the length of the light guide bar is longer than that of the first area of the lamp cover. Two LEDs that emit white light are corresponding to light incident parts on two sides of the light guide bar respectively. Thereby white light emitted from the two LEDs and transmitted through the light guide bar and the first area of the lamp cover is projected in a three-dimensional sense. The two LEDs that emit white light are located outside the range defined by the first area of the lamp cover so that the LEDs and the light spot generated therefrom will not be seen through the first area of the lamp cover. Thus the rear lamp has an enhanced aesthetic appearance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
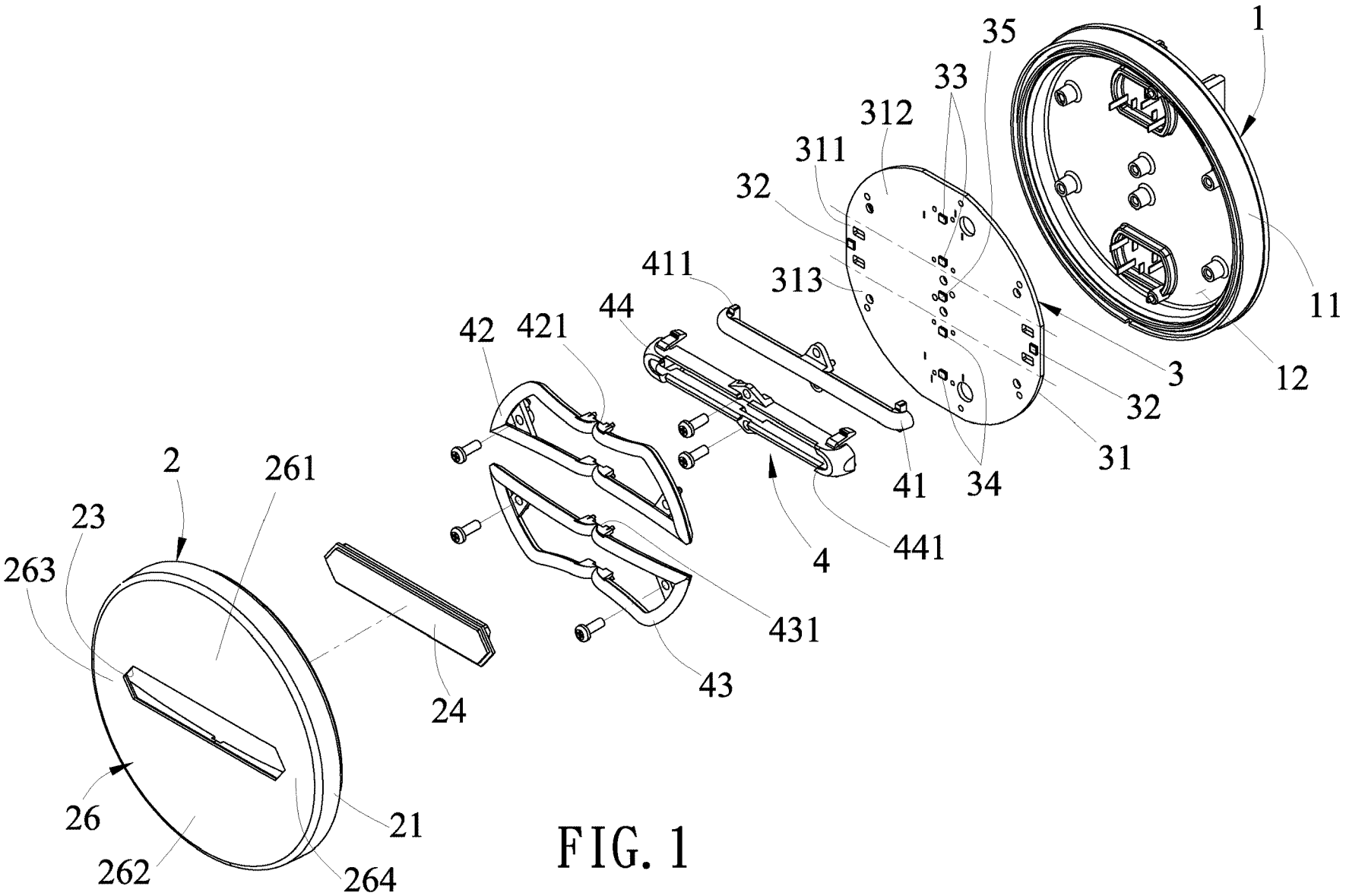
FIG. 1 is an explosive view of an embodiment according to the present invention.
Figure 2:
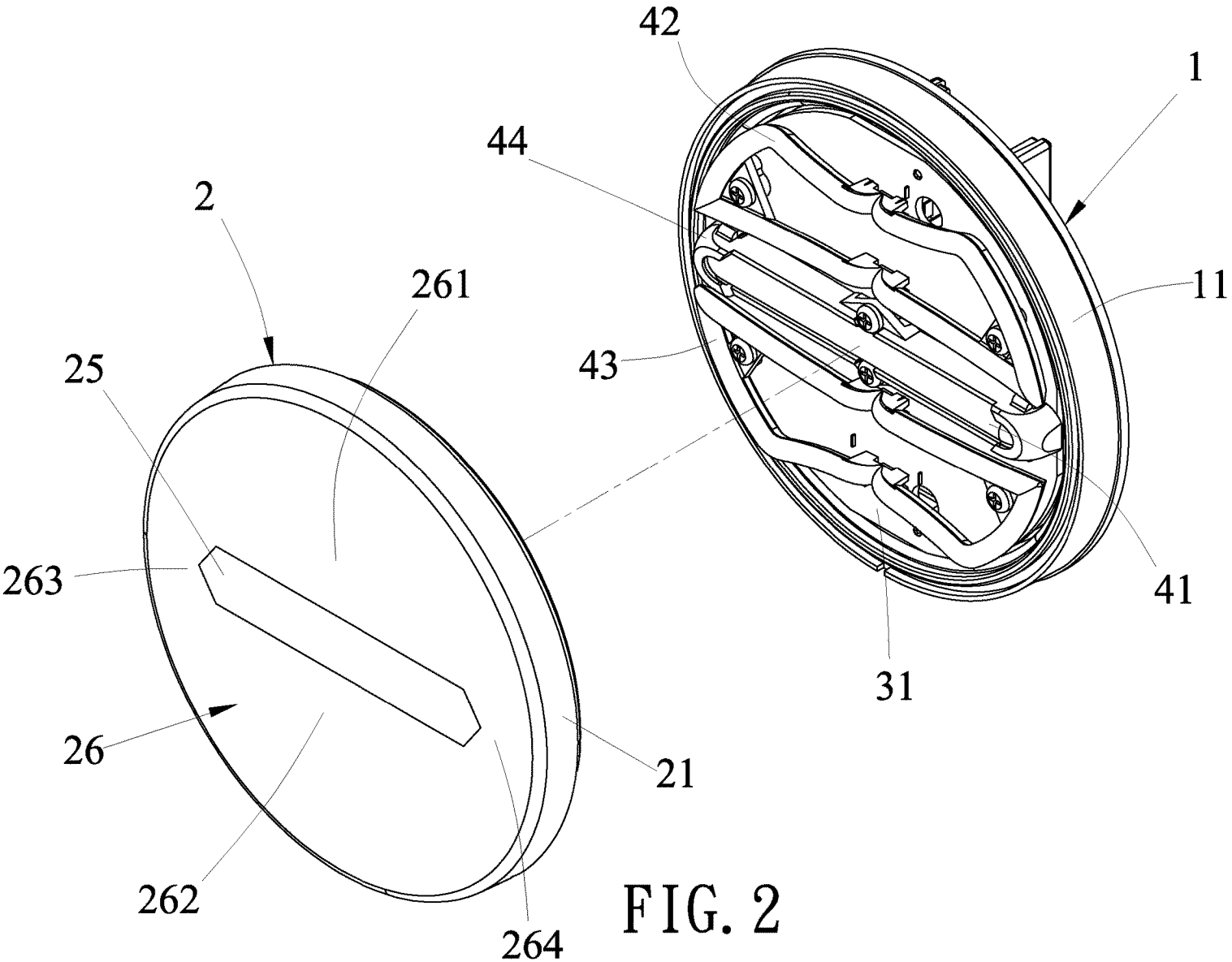
FIG. 2 is another explosive view of an embodiment according to the present invention.
Figure 3:
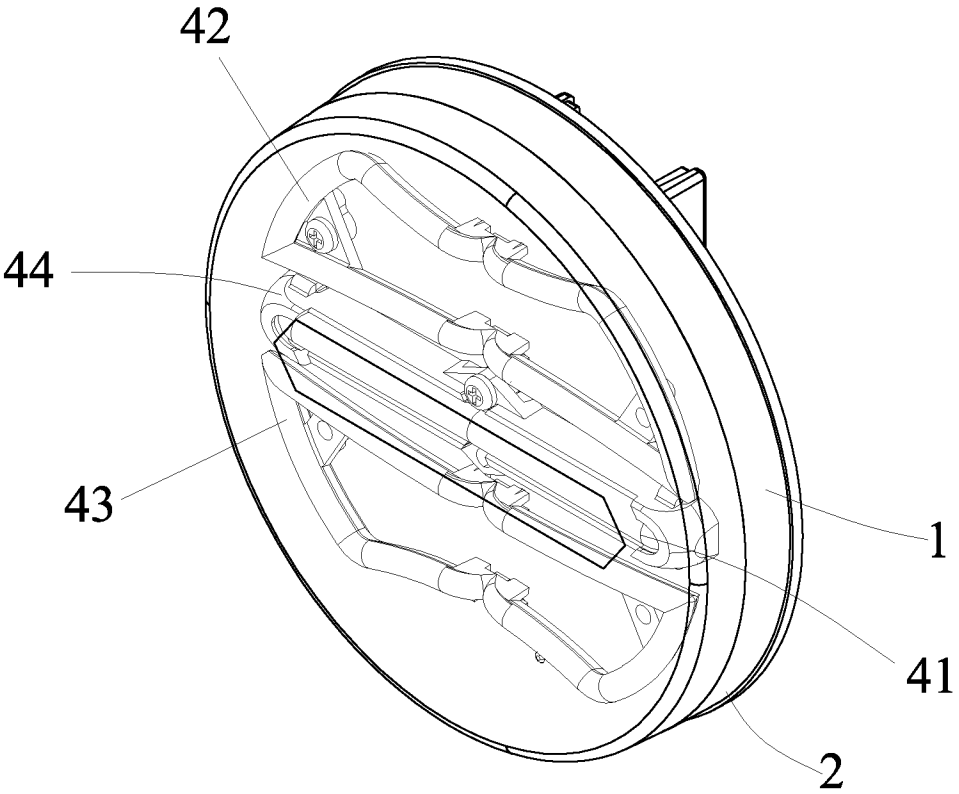
FIG. 3 is a perspective view of an embodiment according to the present invention.
Figure 4:
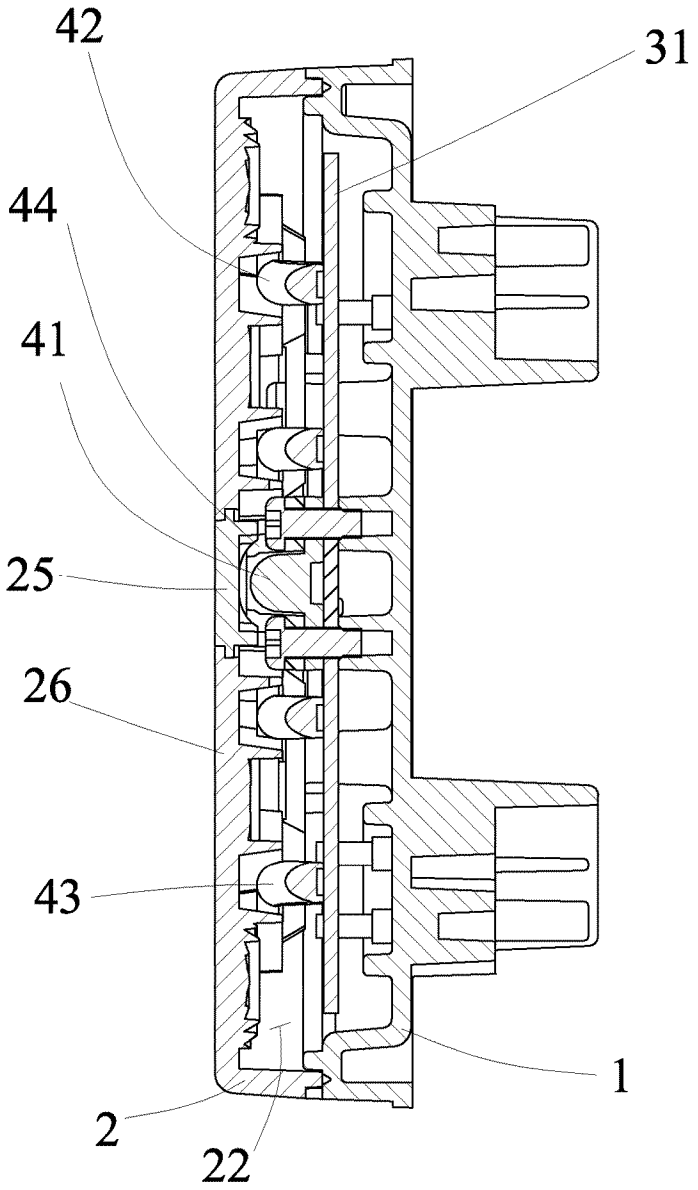
FIG. 4 is a sectional view of an embodiment according to the present invention.

Refer from FIG. 1 to FIG. 4, a combination rear lamp according to the present invention includes a lamp base 1, a lamp cover 2, a light emitting unit 3, and a plurality of light guide bars 4.

The lamp base 1 consists of a circular base body 11 and a mounting recess 12 formed thereof.

The lamp cover 2 is composed of a circular cover body 21 connected to an opening of the mounting recess 12 of the lamp base 1 correspondingly, a mounting space 22 defined by both the lamp cover 2 and the lamp base 1, a through hole 23 formed around a center thereof, and a transparent cover plate 24 assembled on the through hole 23. Thus a transparent first area 25 is formed on a middle part of the lamp cover 2 where the transparent cover plate 24 is provided while a translucent second area 26 in yellow or red color is formed around the first area 25. The translucent second area 26 is divided into a first portion 261, a second portion 262, a third portion 263, and a fourth portion 264. The first portion 261 and the second portion 262 are located adjacent respective opposing sides of the transparent first area 25 of the lamp cover 2. The third portion 263 and the fourth portion 264 are respectively located adjacent a left end and a right end of the transparent first area 25 of the lamp cover 2.

The light emitting unit 3 is mounted in the mounting space 22 formed between the lamp base 1 and the lamp cover 2. The light emitting unit 3 includes a substrate 31, two first light emitting diodes (LEDs) 32, two second light emitting diodes (LEDs) 33 adjacent to each other, two third light emitting diodes (LEDs) 34 adjacent to each other, and at least one fourth light emitting diode (LED) 35. The substrate 31 is formed by a first area 311 located at a middle part, a second area 312 and a third area 313 located adjacent respective opposing sides of the first area 311. The first area 311 of the substrate 31 is corresponding to the transparent first area 25 of the lamp cover 2 and to the third portion 263 and the fourth portion 264 of the second area 26. The second area 312 and the third area 313 are corresponding to the first portion 261 and the second portion 262 of the second area 26 of the lamp cover 2. The two first LEDs 32 are located on two sides of the first area 311 of the substrate 31 respectively. A distance between the two first LEDs 32 is longer than the length of the range defined by the first area 25 of the lamp cover 2 so that the two first LEDs 32 are located outside the left end and the right end of the first area 25 of the lamp cover 2. The first LED 32 emits white light.

The two second LEDs 33 are disposed on a middle part of the second area 312 of the substrate 31 while the two third LEDs 34 are arranged at a middle part of the third area 313 of the substrate 31. The at least one fourth LED 35 is set on a central portion of the first area 311 of the substrate 31. The second LEDs 33, the third LEDs 34, and the fourth LED 35 are all LEDs that emit red light.

The light guide bars 4 consists of a first light guide bar 41, a second light guide bar 42, and a third light guide bar 43, and along with a light shield 44, all are mounted in the mounting space 22 between the lamp base 1 and the lamp cover 2 and fastened on the substrate 31 of the light emitting unit 3. The first light guide bar 41 is disposed on the first area 311 of the substrate 31, also corresponding to and located directly under the first area 25 of the lamp cover 2. The length of the first light guide bar 41 is longer than the length of the range defined between the left end and the right end of the first area 25 of the lamp cover 2 so that two sides of the first light guide bar 41 are outside the range defined by the left end and the right end of the first area 25 of lamp cover 2. A light incident part 411 is formed on each of the two sides of the first light guide bar 41 and the two first LEDs 32 are corresponding to the two light incident parts 411 on the two sides of the first light guide bar 41 respectively. The at least one fourth LED 35 is arranged directly under the first light guide bar 41. The shape of the first light guide bar 41 is not limited, able to be in a geometric shape such as a long strip, wavy shape or S shape. A slot 441 whose shape is in a geometric shape such as a long strip, wavy shape, or S shape corresponding to the first light guide bar 41 is formed on the light shield 44 and the first light guide bar 41 is mounted in the slot 441 of the light shield 44. The second light guide bar 42 is arranged at the second area 312 of the substrate 31, corresponding to a part of the first portion 261 of the second area 26, and located directly under a part of the first portion 261 of the second area 26 of the lamp cover 2. The second light guide bar 42 is in a specific geometric shape and two light incident parts 421 are formed on a middle part thereof. The two second LEDs 33 are corresponding to the two light incident parts 421 of the second light guide bar 42 respectively. As to the third light guide bar 43, it is set on the third area 313 of the substrate 3, corresponding to a part of the second portion 262 of the second area 26 of the lamp cover 2 and located directly under a part of the second portion 262 of the second area 26 of the lamp cover 2. The third light guide bar 43 is also in a specific geometric shape and including two light incident parts 431 formed on a middle part thereof. The two third LEDs 34 are corresponding to the two light incident parts 431 of the third light guide bar 43 respectively.

While in use, the present invention is arranged at each of two sides on the rear side of heavy vehicles such as trucks, trailers, big buses, public vehicles, etc. and used as tail lights. The substrate 31 of the light emitting unit 3 is connected to a controller of the heavy vehicle.

When backing up, the controller of the heavy vehicle outputs a control voltage to the first LEDs 32 of the light emitting unit 3 for driving the first LEDs 32 to emit white light. Then the white light emitted from the first LEDs 32 is projected to the first light guide bar 41 and then transmitted along the first light guide bar 41 so that the first light guide bar 41 emits light evenly. Next the white light emitted from the first light guide bar 41 is transmitted through the transparent first area 25 on the middle part of the lamp cover 2 and projected out. By the light shield 44 set around the first light guide bar 41, the white light emitted from the first light guide bar 41 will not diffuse to be mixed with light from the second area 26 of the lamp cover 2 in yellow or red color. Thereby road users at the rear side can realize that the heavy vehicle is going to reverse and make a response. Moreover, the road users will not feel uncomfortable and blinded because the light from the first LEDs 32 has become uniform after transmitted through the first light guide bar 41. The first LEDs 32 are located just under two sides of the first light guide bar 41, outside the range defined by the first area 25 of the lamp cover 2. Thus road users at the rear side will not see the first LEDs 32 and bright white light generated during lighting of the first LEDs 32 through the first area 25 of the lamp cover 2. The users can only see the first light guide bar 41 that emits light evenly. Thereby visual comfort, appearance and aesthetic are improved when the tail lights are on during backing up of vehicles.

When drivers intend to brake the heavy vehicle, the controller of the heavy vehicle outputs a control voltage to the second LEDs 33, the third LEDs 34, and the fourth LEDs 35 for driving the second LEDs 33 and the third LEDs 34 to project brighter red light to the second area 26 of the lamp cover 2 through the second light guide bar 42 and the third light guide bar 43 as well as driving the fourth LEDs 35 to project brighter red light to the first area 25 of the lamp cover 2 through the first light guide bar 41. By the design of the first light guide bar 41 whose length is longer than the length of the range defined by the first area 25 of the lamp cover 2, the red light is emitted uniformly from the whole surface of the first area 25 and the second area 26 of the lamp cover 2. Thus no dark area is present in the junction between the first area 25 and the second are 26 and good warning effect is provided while braking.

When the heavy vehicle is running on the roads, the controller of the heavy vehicle outputs a control voltage to the second LEDs 33, the third LEDs 34, and the fourth LEDs 35 for driving the second LEDs 33, the third LEDs 34 and fourth LEDs 35 to project red light at the lower luminance level to the first area 25 and the second area 26 of the lamp cover 2 through the first light guide bar 41, the second light guide bar 42, the third light guide bar 43 respectively. The fourth LEDs 35 can be on or off selectively depending on the condition. While operating the turn function, controller of the heavy vehicle outputs a control voltage to the second LEDs 33, the third LEDs 34, and the fourth LEDs 35 for driving the second LEDs 33, the third LEDs 34 and fourth LEDs 35 to project flashing red light to the first area 25 and the second area 26 of the lamp cover 2 through the first light guide bar 41, the second light guide bar 42, the third light guide bar 43 respectively. Moreover, the present invention shows messages by specific geometric shapes of the light from the first light guide bar 41, the second light guide bar 42, and the third light guide bar 43. Thus the road users realize the change in the direction of the heavy vehicle and make a response. Thereby road traffic safety is improved.

Figure 5:
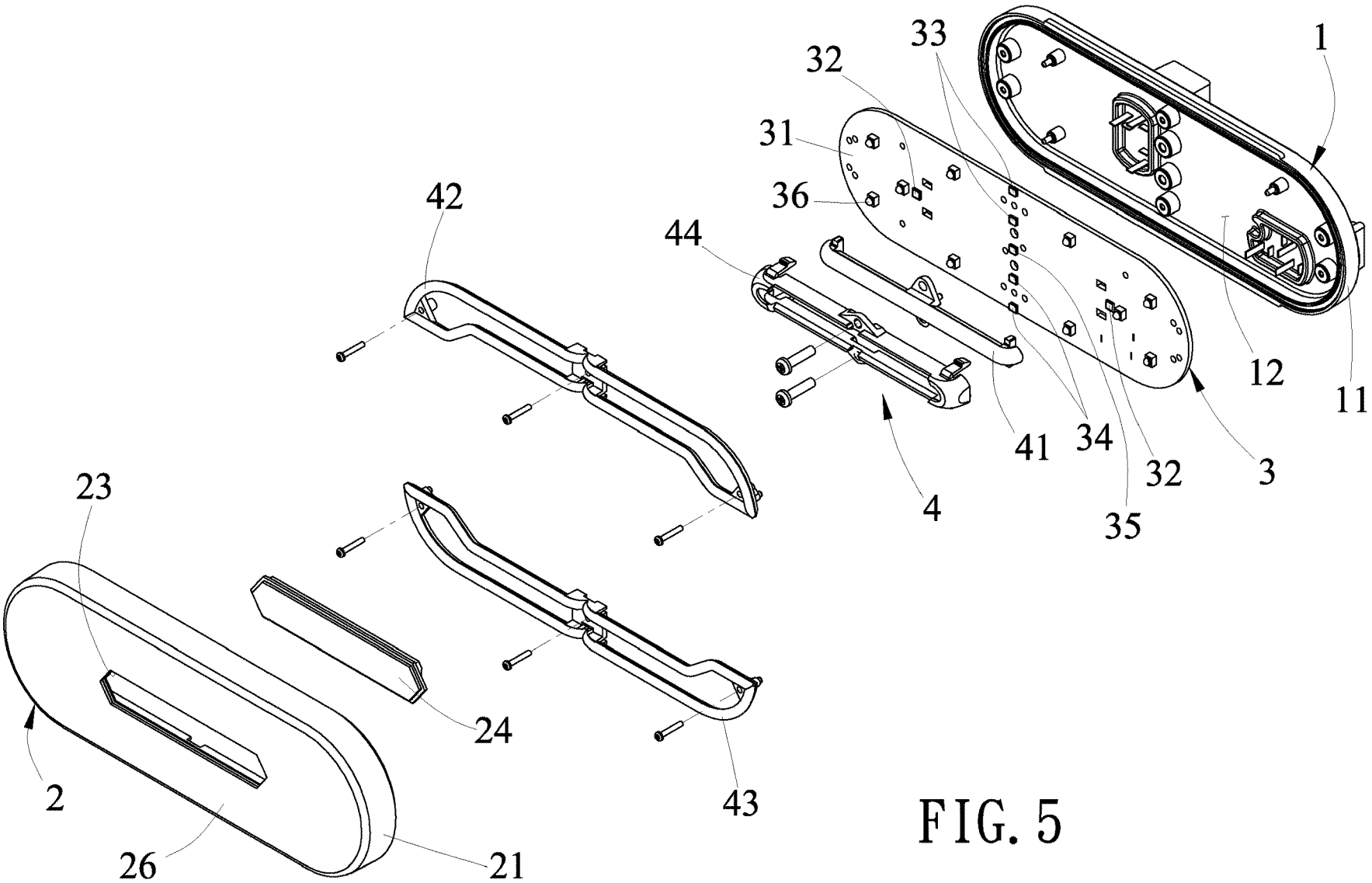
FIG. 5 is an explosive view of another embodiment according to the present invention.
Figure 6:
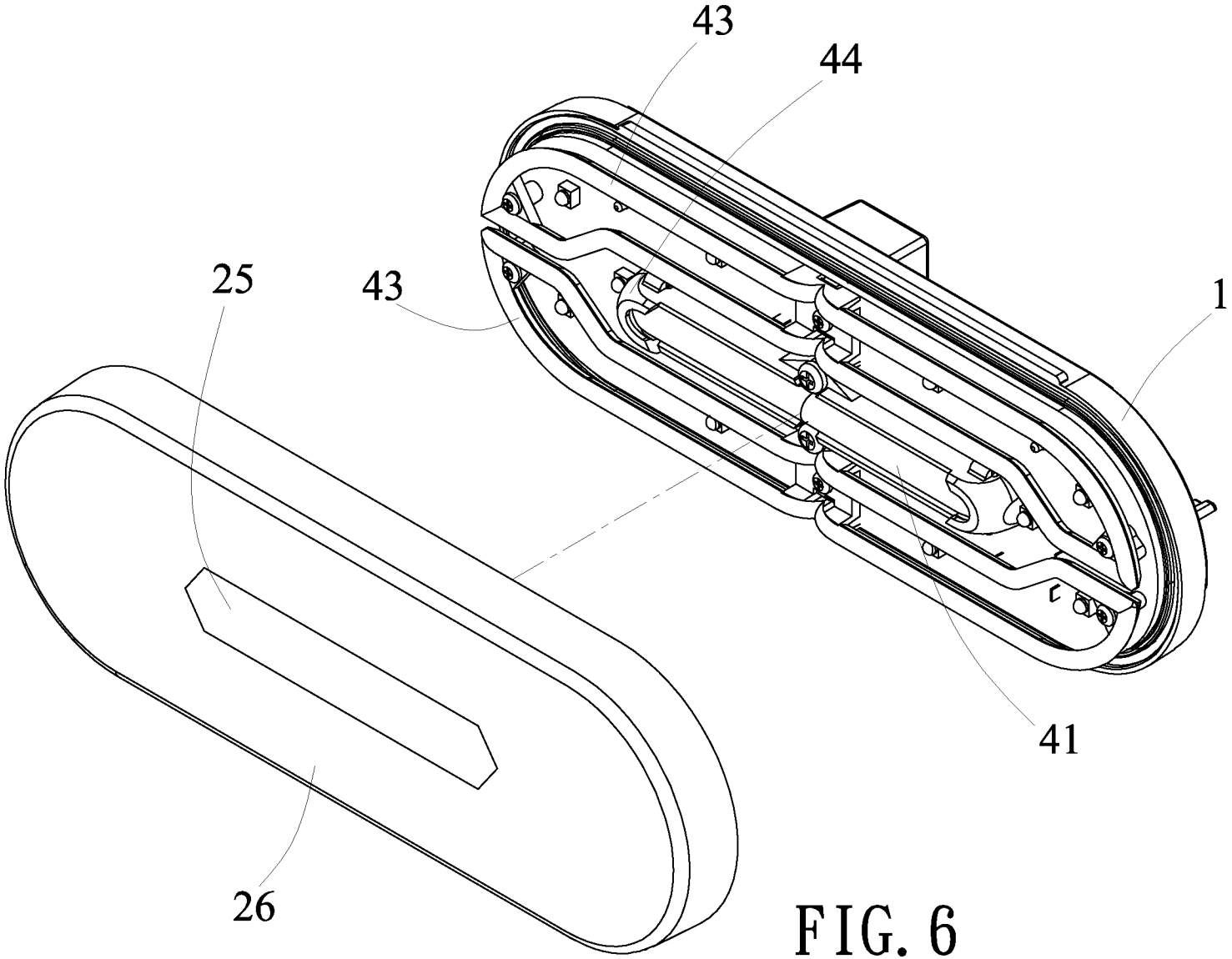
FIG. 6 is another explosive view of another embodiment according to the present invention.
Figure 7:
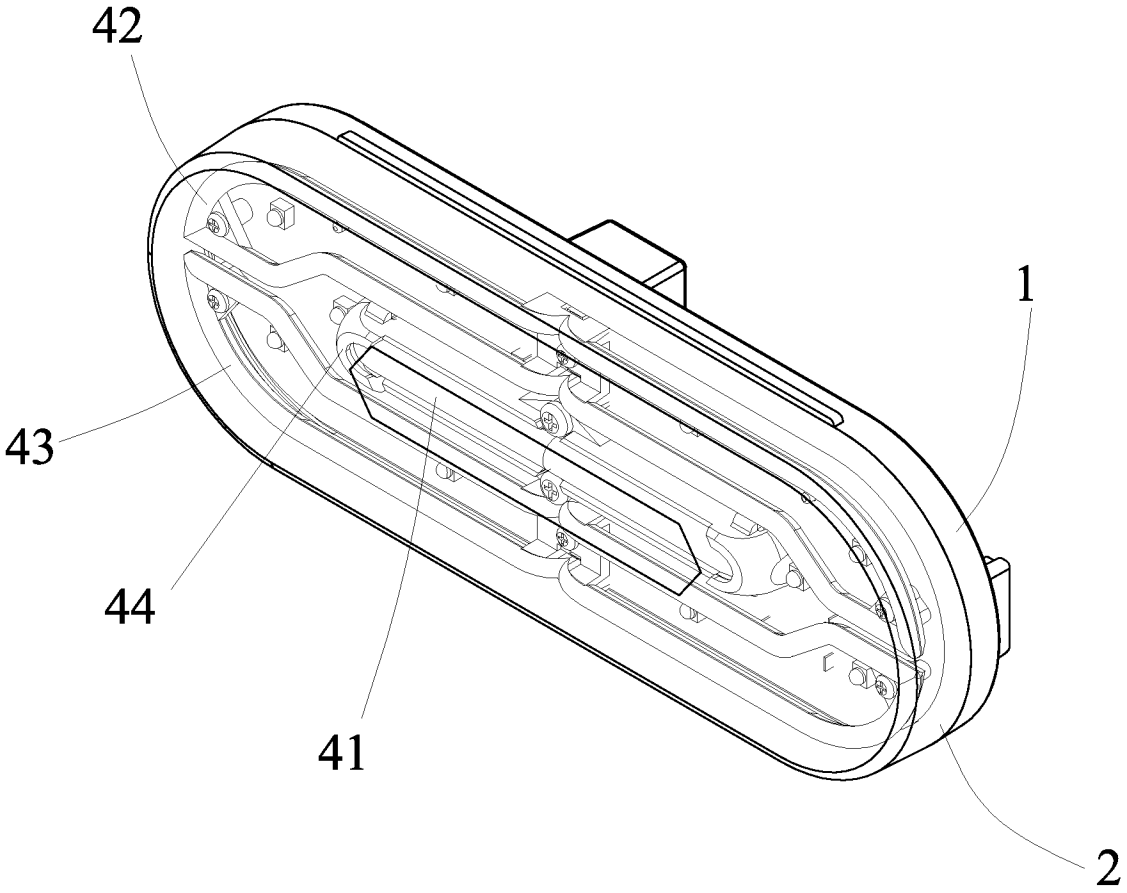
FIG. 7 is a perspective view of another embodiment according to the present invention.

Refer to FIG. 5, FIG. 6, and FIG. 7, another embodiment is revealed. The lamp base 1 includes an elongated base body 11 having semi-circularly shaped end portions. The lamp cover 2 includes a cover body 21 whose shape corresponds to the base body 11 for being connected to the base body 11 of the lamp base 1. Besides the first LEDs 32, the second LEDs 33, the third LEDs 34, and the fourth LEDs 35, the substrate 31 of the light emitting unit 3 can also be provided with a plurality of LEDs 36 according to regulations related to luminance requirements in various countries.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A combination rear lamp, comprising:

a lamp base, a lamp cover connected to the lamp base to form a mounting space therebetween, a light emitting unit disposed in the mounting space and including a substrate and a plurality light emitting diodes (LEDs) arranged on the substrate; and a first light guide bar disposed in the mounting space;

wherein the lamp cover includes a transparent first area formed on a middle portion thereof and a translucent second area in one of yellow or red colors formed around the transparent first area; two first light emitting diodes (LEDs) emit white light and are positioned outside respective left and right ends of the transparent first area of the lamp cover; the first light guide bar is located directly adjacent the transparent first area of the lamp cover; a length of the first light guide bar is greater than a distance between the left end and the right end of the transparent first area of the lamp cover, two opposing ends of the first light guide bar are thereby located outside the left end and the right end of the transparent first area of the lamp cover; a light incident part is formed on each of the two opposing ends of the first light guide bar and the two first LEDs correspond in position to the two light incident parts respectively.

2. The combination rear lamp as claimed in claim 1, wherein the substrate of the light emitting unit includes a first area located at a middle portion thereof, a second area and a third area of the substrate of the light emitting unit are located adjacent respective opposing sides of the first area of the substrate; the two first LEDs are located on opposing ends of the first area of the substrate; the translucent second area of the lamp cover is divided into a first portion and a second portion located adjacent respective opposing sides of the transparent first area of the lamp cover, the translucent second area of the lamp cover is further divided into a third portion and a fourth portion respectively located adjacent the left end and the right end of the transparent first area of the lamp cover; the second area of the substrate and the third area of the substrate correspond in position to the first and second portions of the translucent second area of the lamp cover; two second LEDs are positioned adjacent to each other and located on a central part of the second area of the substrate, two third LEDs are positioned adjacent to each other and located on a central part of the third area of the substrate; a fourth LED is positioned on a central part of the first area of the substrate; the second LEDs, the third LEDs, and the fourth LED all emit red light, the first area of the substrate corresponds in position to the transparent first area and the third and fourth portions of the translucent second area.

3. The combination rear lamp as claimed in claim 2, wherein a second light guide bar and a third light guide bar are disposed in the mounting space between the lamp base and the lamp cover; the fourth LED is arranged directly adjacent the first light guide bar corresponding in position to the transparent first area; the second light guide bar is disposed on the second area of the substrate and corresponding in position to the first portion of the translucent second area of the lamp cover; two light incident parts are formed on the second light guide bar and respectively correspond in position to the two second LEDs; the third light guide bar is set on the third area of the substrate and corresponding in position to the second portion of the translucent second area of the lamp cover; the third light guide bar includes two light incident parts formed thereon that correspond in position to the two third LEDs respectively.

4. The combination rear lamp as claimed in claim 3, wherein a shape of the first light guide bar is selected from the group consisting of a long strip, a wavy shape, and an S shape.

5. The combination rear lamp as claimed in claim 4, further comprising a light shield; a slot is formed through the light shield and the slot is shaped as one of a long strip, a wavy shape, or an S shape for corresponding to the shape of the first light guide bar, the first light guide bar is thereby mountable in the slot of the light shield.

6. The combination rear lamp as claimed in claim 3, wherein the second light guide bar and the third light guide bar have respective predetermined geometric shapes.

7. The combination rear lamp as claimed in claim 1, wherein the lamp base has a circular base body, and the lamp cover has a circular cover body connected to the circular base body of the lamp base.

8. The combination rear lamp as claimed in claim 1, wherein the lamp base includes an elongated base body having semi-circularly shaped end portions; the lamp cover includes an elongated cover body having semi-circularly shaped end portions for being connected to the base body of the lamp base.

9. The combination rear lamp as claimed in claim 1, wherein a through hole is formed through a center of the lamp cover and a transparent cover plate is mounted at the through hole; the transparent first area of the lamp cover is formed at a position corresponding to the transparent cover plate.

* * * * *